United States Patent [19]

Gubau et al.

[11] 4,390,293

[45] Jun. 28, 1983

[54] ELECTRONIC TYPEWRITER

[75] Inventors: Giuseppe Gubau, Ivrea; Domenico Roano, Parella; Giovanni Quaranti, Banchette, all of Italy

[73] Assignee: Ing. C. Olivetti & C., S.p.A., Turin, Italy

[21] Appl. No.: 215,722

[22] Filed: Dec. 12, 1980

[30] Foreign Application Priority Data

Dec. 21, 1979 [IT] Italy ..... 69450 A/79

[51] Int. Cl.[3] ..... B41J 1/30

[52] U.S. Cl. ..... 400/144.2; 101/93.19; 400/157.2

[58] Field of Search ..... 400/144.2, 144.3, 157.1, 400/157.2; 101/93.17, 93.19, 93.35, 93.36, 93.48

[56] References Cited

U.S. PATENT DOCUMENTS

| | | | |
|---|---|---|---|
| 3,371,766 | 3/1968 | Staller | 400/144.3 |
| 4,049,109 | 9/1977 | Plaza et al. | 400/144.2 X |
| 4,119,384 | 10/1978 | Keiter | 400/144.2 |
| 4,178,107 | 12/1979 | Guerrini et al. | 400/144.2 |
| 4,203,675 | 5/1980 | Osmera et al. | 400/144.2 |
| 4,226,546 | 10/1980 | Hoffman | 400/144.2 |
| 4,239,400 | 12/1980 | Giolitti | 400/144.2 |
| 4,249,829 | 2/1981 | Link et al. | 400/144.2 |

FOREIGN PATENT DOCUMENTS

| | | | |
|---|---|---|---|
| 134619 | 3/1979 | Fed. Rep. of Germany | 400/144.2 |
| 1514272 | 10/1975 | United Kingdom . | |
| 2018684 | 4/1979 | United Kingdom . | |

*Primary Examiner*—Paul T. Sewell
*Attorney, Agent, or Firm*—Edward F. McKie, Jr.

[57] ABSTRACT

The electronic typewriter comprises a character-carrier disc with flexible blades, which is mounted on a carriage which is movable transversely with respect to the typing roller by means of a stepping motor. Mounted on the carriage is a motor for selecting the character, a striker hammer, a positioning device and an actuating motor which actuates the hammer and the positioning device and which also provides for activating the operations by means of a typing ribbon and by means of a correction ribbon. The selection motor is supplied by a servo control of digital type which imparts to the motor a speed which is proportional to the positional error, positioning the blade of the character to be typed with a maximum error of $\pm\frac{1}{4}$ of a pitch. The positioning device then provides for correction of the character, engaging a recess of a positioning disc which is synchronous with the character-carrier disc.

20 Claims, 18 Drawing Figures

24
23
129
130
131
113
47
34
25
31
48
87
125
35
126
124
115
86
109
99
36
39
50
116
127
34
37
85
82
96
58
56
40
49
75
57
38
106
42
37
34
76
82
79
74
55
33
78
77
81
84
69
108
111
91
110
36
95
83
101
35
104
31
88
90
48
83
34
47
132
137
128
24

ELECTRONIC TYPEWRITER

BACKGROUND OF THE INVENTION

The present invention concerns an electronic typewriter comprising a character-carrier disc with flexible blades, and a motor for selecting the blade which carries the character to be typed.

A print device of this type is known, wherein the position of the disc is detected by a transducer which provides analog information, adjacent to each of the angular positions in which the blades of the disc can be selected. The disc selection motor is supplied by a servo control which, adjacent the position of selection of the disc, is controlled by the analog signal of the transducer which produces a zero when the blade is perfectly centered. Since the degree of accuracy in regard to positioning of the disc depends directly on the degree of accuracy of the transducer and the response of the circuits, this arrangement requires the use of very expensive components. Because of the cost involved, this makes it prohibitive to use an arrangement of this type in a typewriter and in particular in a portable typewriter.

SUMMARY OF THE INVENTION

The main aim of the present invention is therefore to provide an electronic typewriter which has highly accurate and reliable positioning of the character-carrier disc and which uses relatively inexpensive components. In accordance with this aim, the electronic typewriter of the present invention is characterised by a digital transducer which detects the angular position of the disc, a digital speed control circuit, controlled by the transducer, which actuates the motor for coarse positioning of the blade of the selected character, a series of correction elements which are movable synchronously with the characters of the disc, and a correction member controlled by the transducer and engageable with said correction elements, which precisely positions said blade in front of the point of typing.

In accordance with another feature, between the selection motor and the disc is disposed a pair of gears for reducing the speed of the disc with respect to the speed of the motor, while the position transducer is fitted directly on the fixing shaft of the character-carrier disc in order to reduce the errors due to play.

In accordance with a further feature, the character-carrier disc is mounted on a carriage which is movable transversely with respect to the paper roller and there are also provided an actuating motor mounted on the carriage, elements for connecting between the actuating motor, a hammer for striking the selected character and/or the correction member of the disc and a circuit for controlling the actuating motor for consequent actuation of the hammer and/or the correction member connected thereto.

DESCRIPTION OF THE DRAWING

These and other features of the invention will be apparent from the following description which is given by way of non-limiting example with reference to the accompanying drawings in which.

DESCRIPTION OF THE ILLUSTRATED EMBODIMENT

Figure 1:
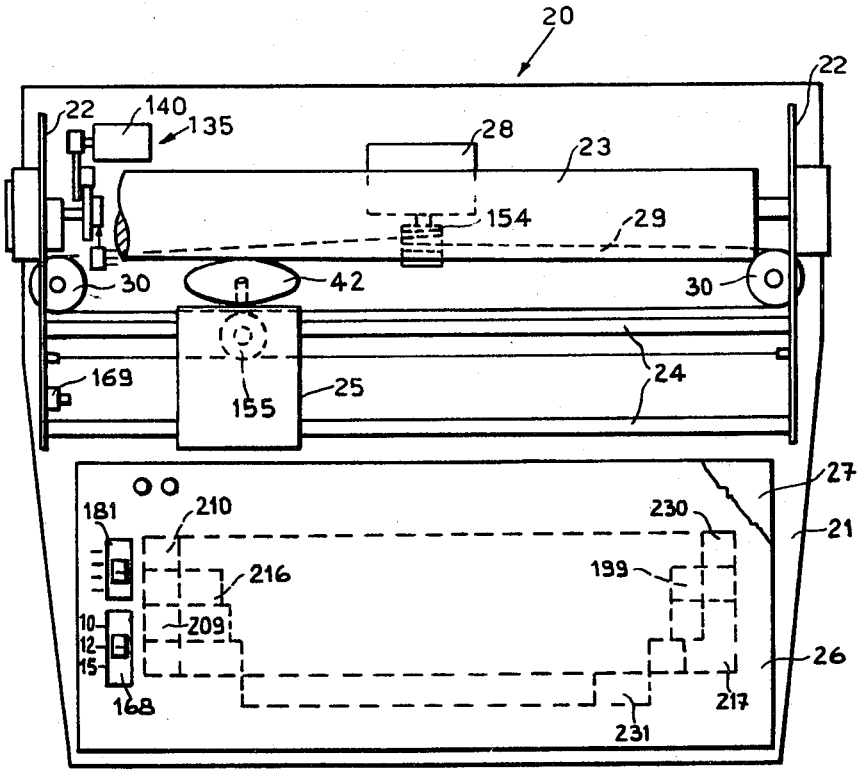
FIG. 1 is a diagrammatic plan view of the typewriter according to the invention.

Referring to FIG. 1, the electronic typewriter indicated by reference numeral 20 comprises a base 21 carrying a frame 22 which supports a typing roller 23, a line space mechanism 135 and two bars 24 which movably guide a print unit 25. Also fixed on the base 21 are a keyboard 26 of contact type, a plate for an electronic control unit as indicated at 27, and a motor 28 which provides for the transverse movement of the print unit 25, by means of a cable 29 and a pulley 30.

The unit 27 receives from keyboard 26 the code of the character to be typed and of the functions to be performed and provides for passing the related commands to the print unit 25, the motor 28 and the line space mechanism 135.

Print Unit

Figure 2:
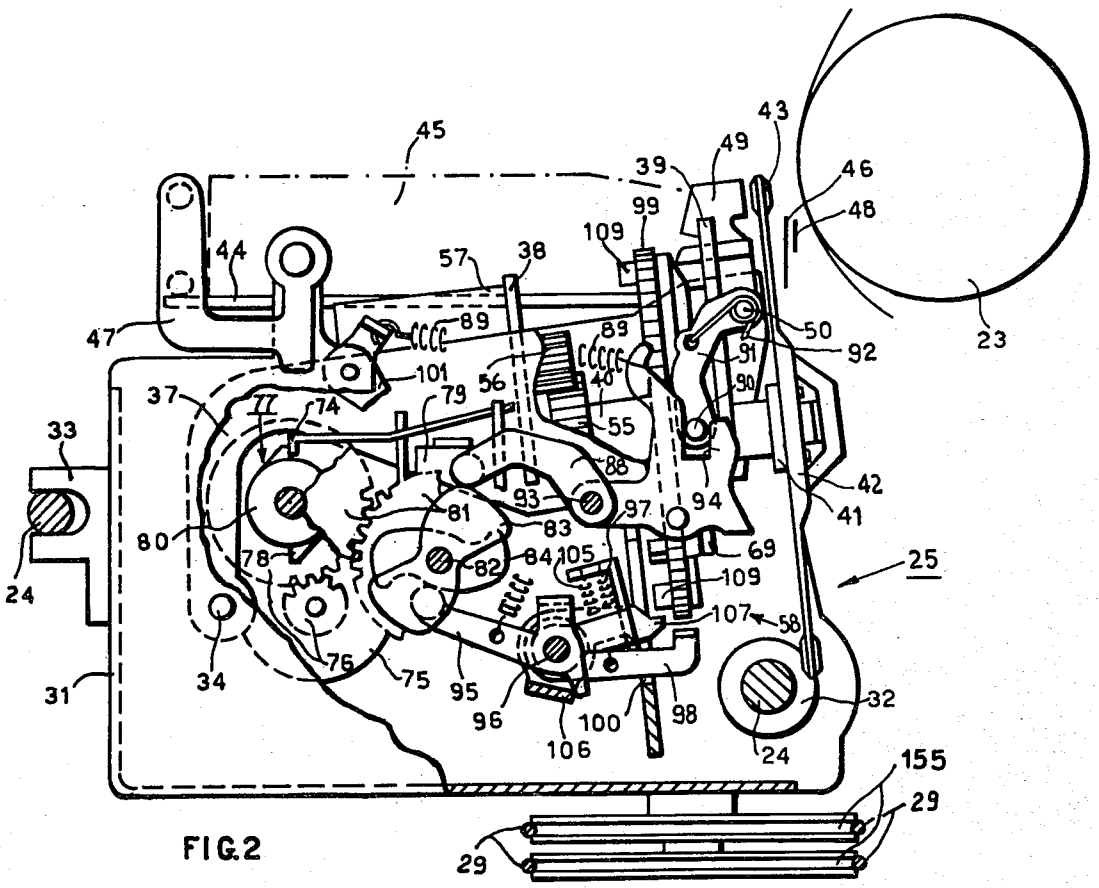
FIG. 2 is a side view of part of the machine of FIG. 1, showing detail thereof.
Figure 3:
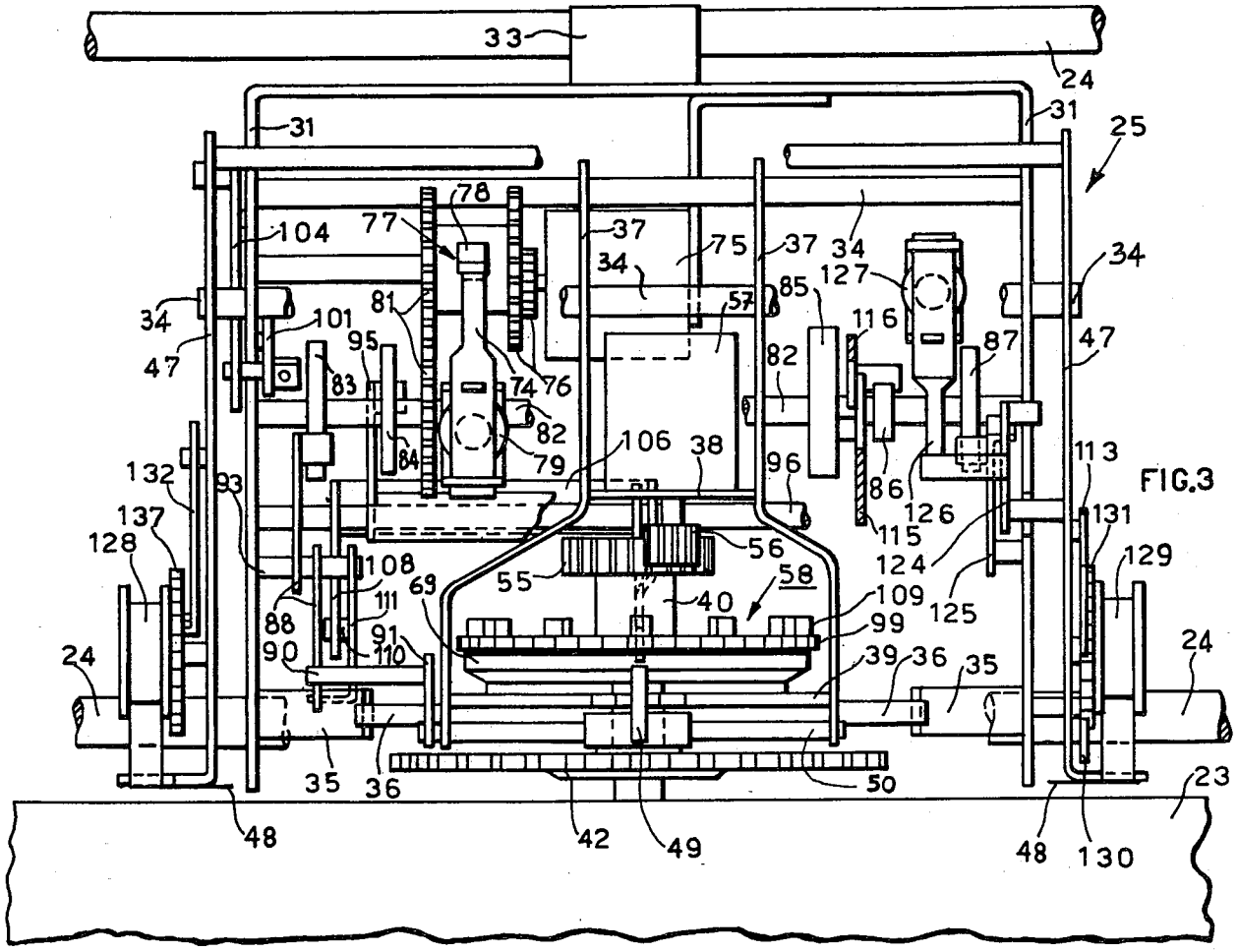
FIG. 3 is a plan view of the detail of FIG. 2.

With reference now to FIGS. 2 and 3, the print unit 25 comprises a carriage 31 which is guided by the bars 24, by means of ring members 32 and a fork member 33. Pivoted on the carriage 31 by means of a shaft 34 are the side members of a support 37 which can be locked to the carriage 31 by means of two pins 36 of the support 37 (FIG. 3) and two clips or spring positioning means 35 of the carriage 31. The support 37 is provided with two substantially vertical plates 38 and 39 between which a drive shaft 40 is rotatable. A character-carrier element 42 of the "daisy" type which carries 100 characters 43, substantially as described in the present applicant's Italian Pat. No. 1 016 590, is fixed by means of a locking element 41 to one end of the shaft 40, which projects from the plate 39 towards the roller 23.

Figure 4:
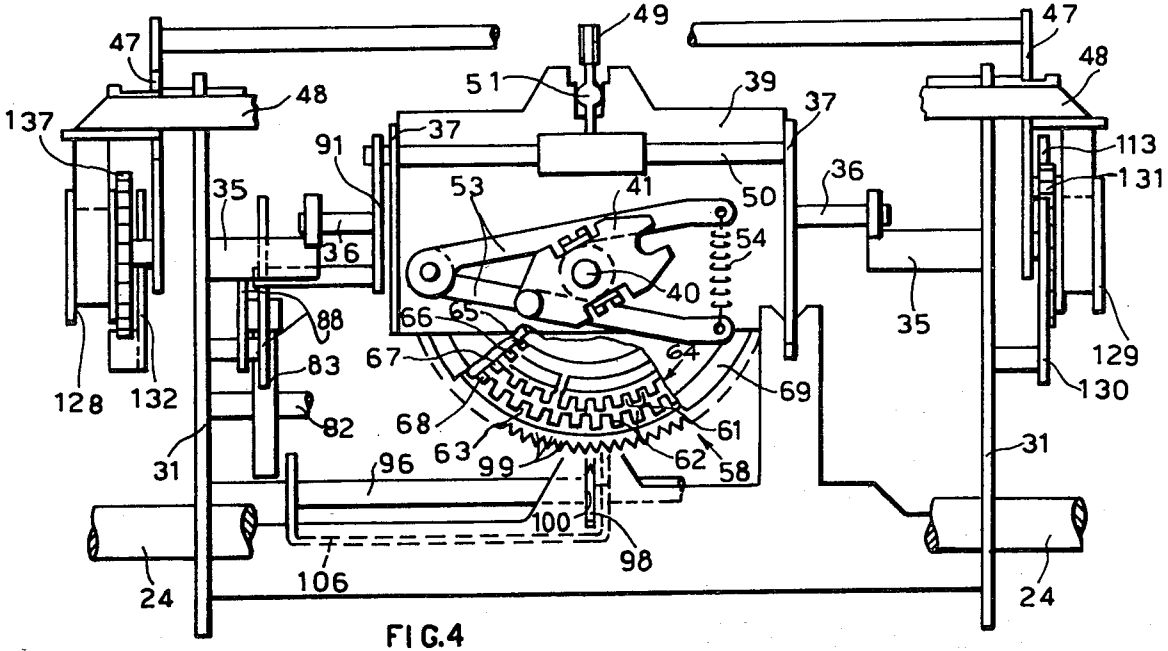
FIG. 4 is a front view of the detail of FIG. 2.

Pivoted on the carriage 31 are an oscillating plate 44 which acts as a support for a cartridge 45 for a typing ribbon 46 (shown in dash-dotted line in FIG. 2) and a frame 47 for guiding a correction ribbon 48. The characters 43 are struck by means of a hammer 49 which is guided by a recess or opening 51 in the plate 39 (see also FIG. 4) and fixed on a shaft 50 pivoted between the side members of the support 37.

Figure 14:
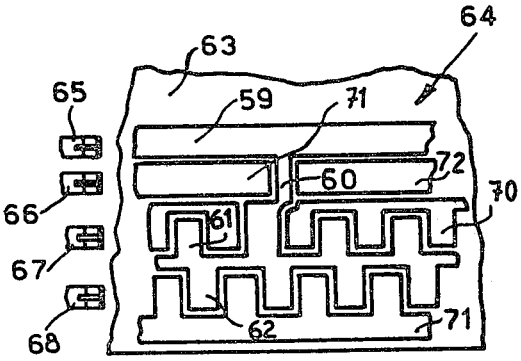
FIG. 14 is a view on an enlarged scale of a detail of FIG. 4.

For the purposes of selecting the characters 43 on the shaft 40, between the plates 38 and 39, there is fixed a toothed wheel 55 which engages with a pinion 56 of an electric motor 57 which in turn is fixed on the plate 38. Also fixed on the shaft 40 is a positioning element 58 which constitutes a brush-type positioning transducer and which supplies the electronic control unit with digital data regarding the angular positioning of the daisy 42 and the direction of rotation thereof, if appropriate. The element 58 also comprises a correction wheel which contributes to correction of the angular position of the daisy 42 and to the control of the strength of striking of the hammer 49. Pivoted on the plate 39, in a scissors-type configuration, are two arms 53 (see FIG. 4) which, by the force of a spring 54, press on the hub of the locking element 41, thus braking it in such a way as to prevent undesired oscillatory movements of the daisy 42. The element 58 is in the form of a disc and, on an insulating surface 63, carries a printed circuit 64 provided with a common conductor track 59 which is connected and concentric to a synchronisation track provided with a contact area with a single tooth 60 (FIG. 14) and with two switching areas or tracks 61 and 62 which are each provided with contact areas with fifty teeth. The teeth of the two tracks 61 and 62 are out-of-phase with respect to each other by 90° and the spaces between the teeth occupy approximately 50% of the length of the two tracks. In this way, the edges of the two tracks 61 and 62 define two hundred different angular positions of the shaft 40 (FIG. 4) and thus of the daisy 42. Fixed on the plate 39 opposite the surface 63 is a cap 69 which protects the printed circuit 64 and fixes four brushes 65, 66, 67 and 68 which respectively slide against the tracks 59, 60, 61 and 62 for detecting the positions and the direction of movement of the shaft 40 in per se known manner. In addition, for the purposes of reducing wear of the brushes 65–68 (FIG. 14) by virtue of the brushes sliding over the surface of the insulating face 63, which is usually somewhat abrasive, the empty portion adjacent the teeth of the tracks 61 and 62 and the conducting area 60 is partially covered by metal layers 70, 71 and 72 which are made from the same material as the conductor tracks but are electrically insulated therefrom.

In accordance with a feature of the present invention, an operating motor 75 is fixed on the carriage 31 (see FIG. 2). The motor 75 provides the power required for correction of the position of the daisy 42 and for striking the hammer 49 on the blade of the character 43 selected. In addition, the motor 75 provides for raising and feeding the ribbon 46 and possibly for the similar functions in respect to the correction ribbon 48.

In particular, by means of a pair of speed-reducing wheels 76, the motor 75 rotates the drive portion of a spring-type clutch 77 whiich is normally open and whose driven portion 80 is provided with two control teeth 78 each of which can be released by the armature 74 of a solenoid 79. When the two teeth 78 are released and the clutch 77 is closed, the driven portion 80 drives a cam-carrier shaft 82, by way of a pair of toothed wheels 81. Fixed on the shaft 82 are two cams 83 and 84 which respectively control striking movement of the hammer 49 and correction of the angular position of the daisy 42, and three cams 85, 86 and 87 (see FIG. 5) which control the functions of the typing ribbon 46 (see FIG. 2) and the correction ribbon 48.

Figure 8:
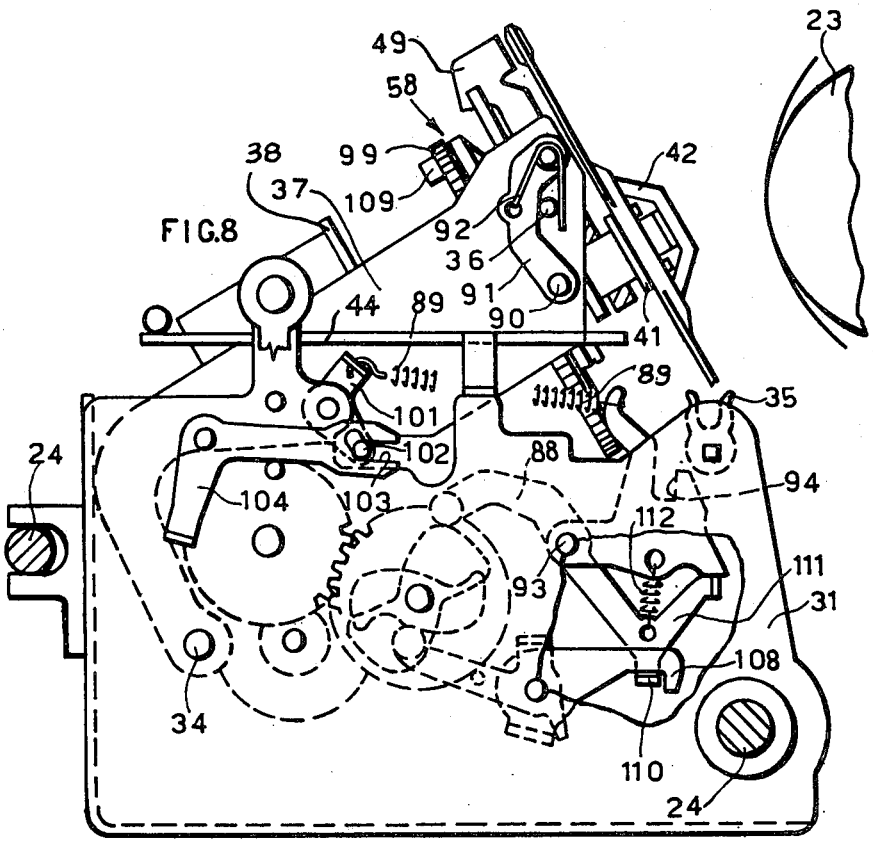
FIG. 8 is a side view of the assembly of FIG. 2 in a working position.

For controlling the striking motion of the hammer, the cam 83 engages a cam follower striker lever 88 pivoting about a pivot pin 93 on one side of the carriage 31 and which fixes one end of a striker spring 89. The other end of the spring 89 is fixed to a regulating lever 101 (see FIG. 8) which is pivoted on the carriage 31 and which is connected, by way of a pivot pin 102, to a slot 103 in a lever 104, which is also pivoted on the carriage 31 and which can be manually moved into one of two stable positions in order to vary the tension of the spring 89. The lever 88 (see FIG. 2) is connected by way of a slot 94 to a pivot pin 90 of an intermediate lever 91 which is fixed on the shaft of the hammer 49, while a light hair-pin spring 92 tends to hold the hammer 49 in its rest position, spaced from the daisy 42.

For correction of the angular position of the daisy, the cam 84 engages a cam follower lever 95 whch is pivoted on a shaft 96 and which is connected, by way of a resilient coupling means 97, to a positioning tooth 98 which is also pivoted on the shaft 96 and guided in a recess or opening 100 of the carriage 31. The tooth 98 (see FIG. 4) is capable of engaging a recess or opening of a series of a hundred V- shaped recesses 99 which are associated with the characters 43 of the daisy 42 (see FIG. 5) and which are provided on the cylindrical edge of the positioning element 58.

For automatic control of the strength of the striking action, the lever 95 is finally connected, by way of a second resilient coupling means 105, to a bridge element 106 which is pivoted on the shaft 96 and which is provided with an arm 107 and with a coupling means 108. The arm 107 is guided by the recess 100 and is capable of co-operating selectively with a tooth 109 which can be associated with one of the characters 43 and which projects from the positioning element 58. The coupling means 108 (see also FIGS. 3, 8) is capable of co-operating with a stop 110 of a small lever 111 which is pivoted on the pin 93 and connected to the striker lever 88, by means of a spring 112. The spring 112 is capable of receiving part of the force of the striker spring 89 when the arm 107 does not meet any tooth 109 of the positioning element 58.

Figure 5:
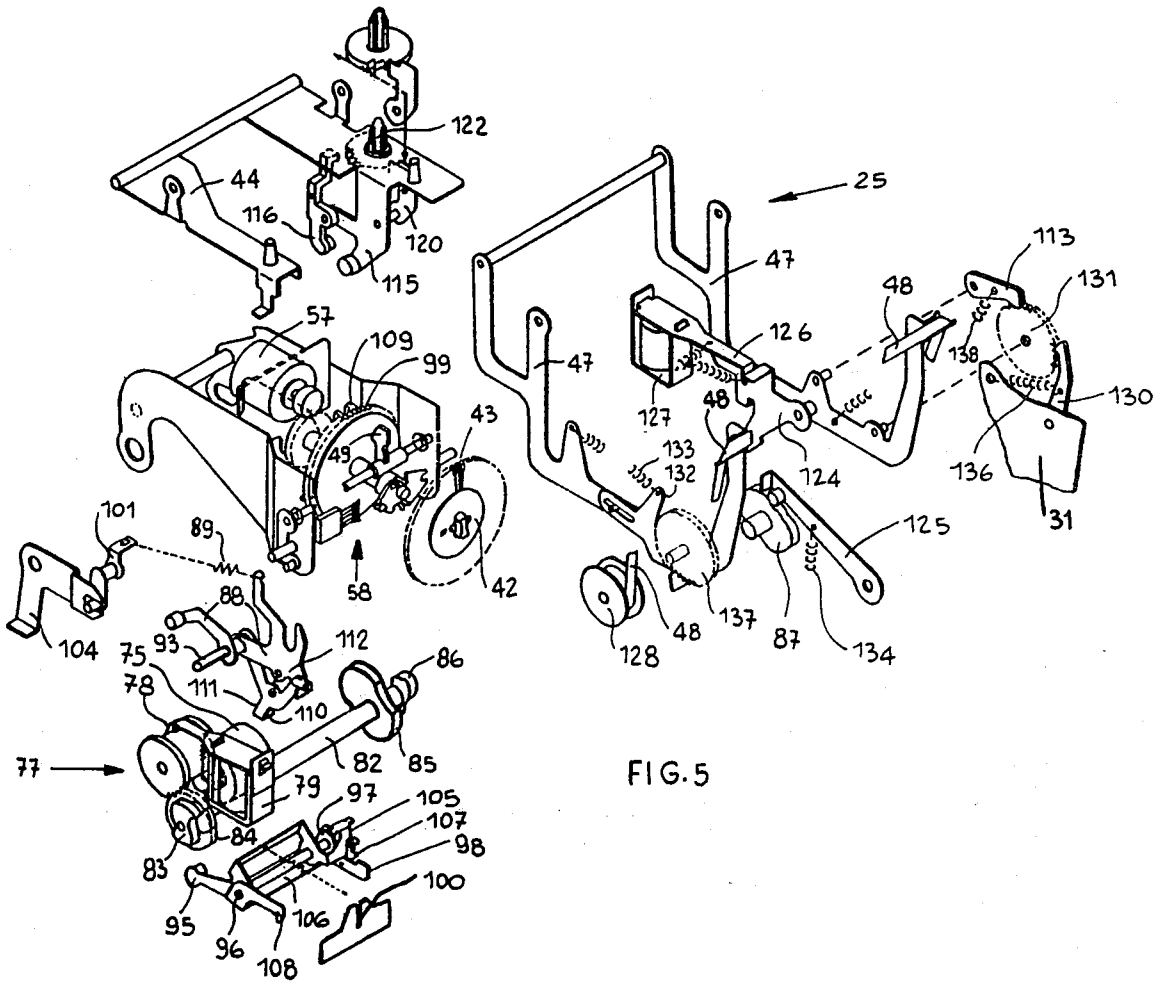
FIG. 5 is an exploded perspective view of the detail of FIG. 2.
Figure 7:
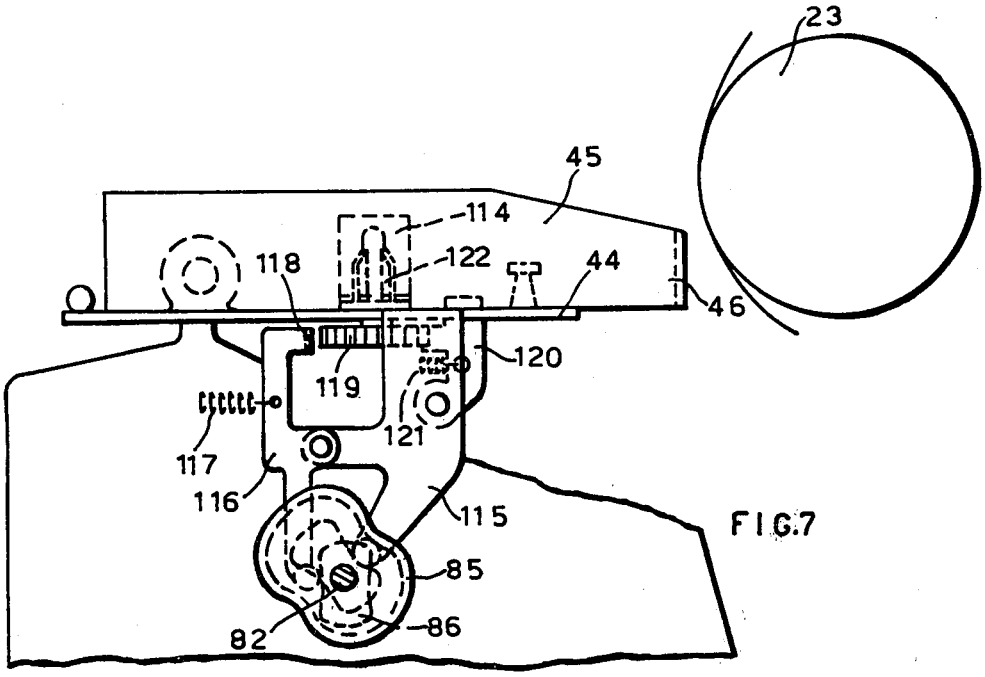
FIG. 7 is a side view of another part of the assembly of FIG. 2.
Figure 11:
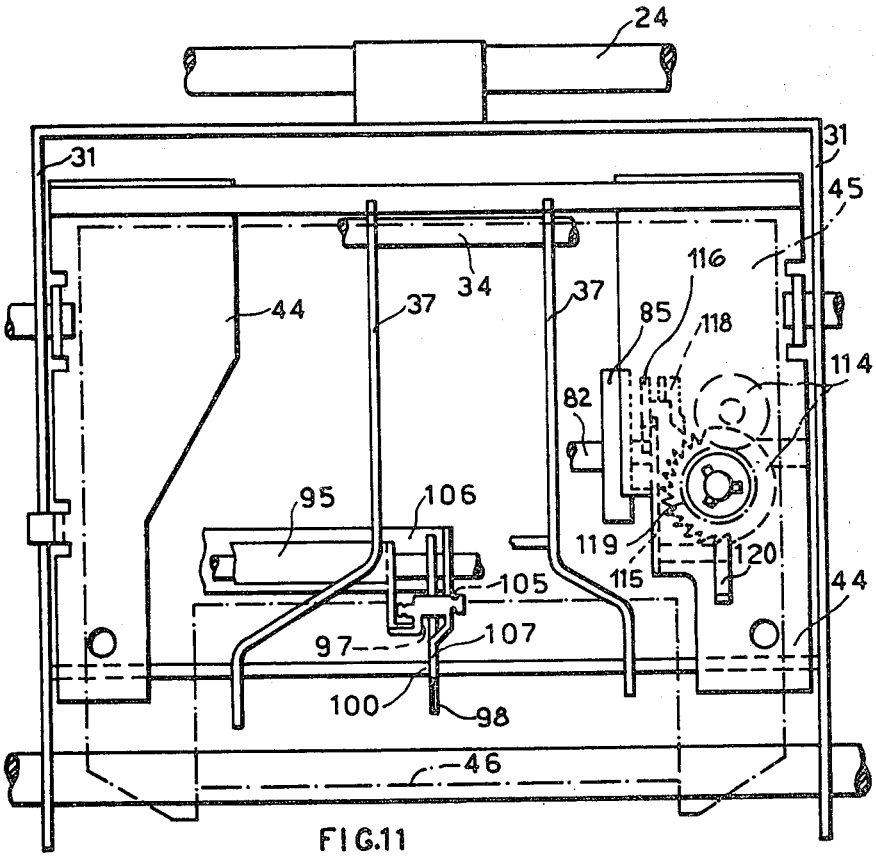
FIG. 11 is a plan view of some parts of the detail assembly of FIG. 1.

For the typing ribbon 46 mode (See FIG. 7), the cam 85 is of the type with grooves or channels therein, with two cam lobes with a different rise. the cam 85 co-operates with a cam follower 115 which is fixed on the oscillating plate 44, on the side of the carriage 31 remote from that of the lever 88 (see also FIG. 5). The cam 85 provides for visibility of the typing point and for different raising movements of the cartridge 45 and the ribbon 46, thus making it possible to use ribbons 46 with two typing tracks disposed one above the other. In addition, for the forward feed movement of the ribbon 46, the machine is provided with a small lever 116 (see also FIG. 11) which is privoted on the cam follower 115 and, by the action of a spring 117, co-operates with the cam 86 which also has two cam lobes with different rises and, by means of a tooth 118, engages with a wheel 119 with sawtooth-shaped teeth of a driven spindle 122 which is capable of engaging a wheel of a pair of wheels 114 (see FIG. 11) of the cartridge 45, which wheels provide for the uni-directional feed movement of the ribbon 46. Finally, a lever 120 which is pulled by a spring 121 provides for a locking action in respect of reverse rotation of the wheel 119.

Figure 6:
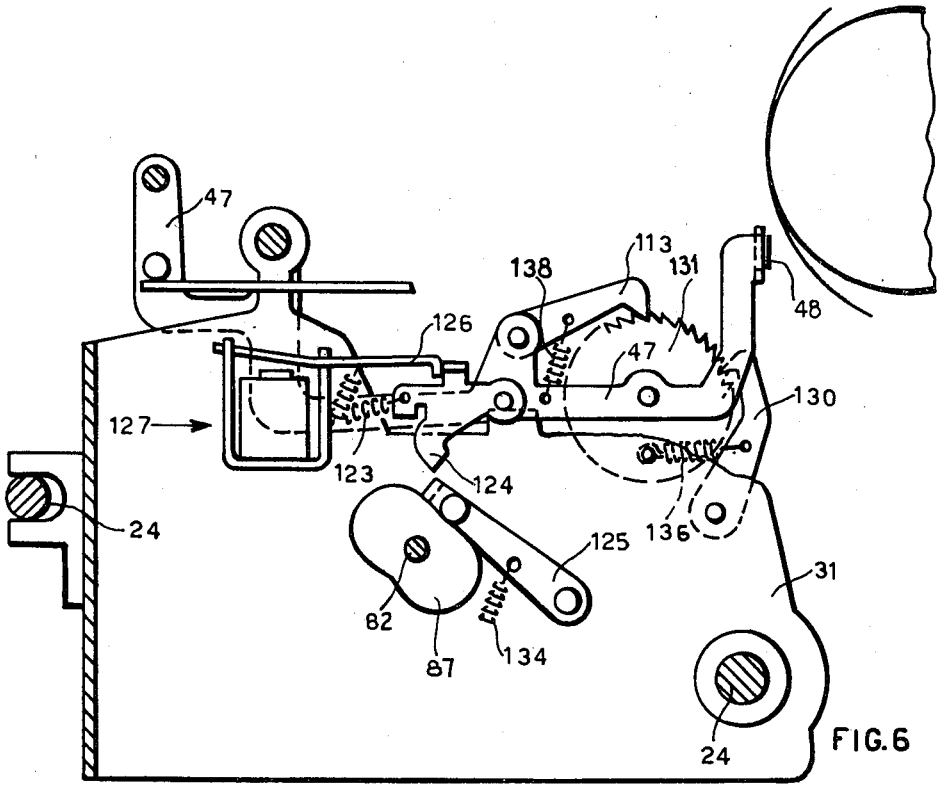
FIG. 6 is a side view of a detailed part of the assembly of FIG. 2.

For raising the correcting ribbon 48, the cam 87 (see FIG. 6) co-operates, by means of the force of a spring 134, with a cam follower lever 125 which is arranged selectively to pull the frame 47 of the correcting ribbon 48 in an upward direction, by means of an interposition lever 124 which is pulled by a spring 123, (FIG. 6) being pivoted on an arm of the frame 47 and being controlled by the armature 126 of a solenoi 127. In particular, the correcting ribbon 48 unwinds from a feed spool 128 (FIG. 3) and winds onto a receiving spool 129. The two spools 128 and 129 are mounted on the two arms of the frame 47 and have their axes of rotation parallel to the typing roller 23 and are removably fixed on two corresponding sawtooth wheels 137 and 131.

A lever 130 which is pivoted on the carriage 31 is engaged with the toothed wheel 131, by virtue of the force of a spring 136 (FIG. 5) and provides for the forward feed movement of the ribbon 48 which is wound onto the spool 129, jointly with the lifting movement thereof by means of the frame 47. A lever 113 to which a pulling force is applied by a spring 138 and which is pivoted on the frame 47 prevents the rotary movements of the wheel 131, which unwind the ribbon 48. A lever 132 which is pivoted and slideable on the frame 47, by virtue of the force of a spring 133, normally engages the teeth of the wheel 137 and maintains a constant tension in the ribbon 48 which is wound onto the spool 128, while it is entrained and skips over the wheel 137 during the normal forward feed movement of the ribbon 48.

In operation of the print unit 25, for each typing cycle, the control unit 27 supplies constant power to the motor 75 and pulse-type power to the selection motor 57 (FIG. 2). in a manner which will be described hereinafter, until the blade of the character 43 is positioned in front of the hammer 49 with a degree of angular precesion of $\pm\theta$ of a pitch with respect to the centered position thereof. When this position has been reached, the unit 27 actuates the solenoid 79 whch frees one of the teeth 78 of the clutch means 77, driving the cam shaft 82 in rotation.

The cam 85 (see FIG. 7) begins to raise the plate 44 in order to position one of the two tracks of the ribbon 46 in front of the point of typing. In addition, the cam 86 and the lever 116, by way of the tooth 118 and the wheel 119, cause rotary movement of the drive shaft or stub 112 and one of the wheels 114 of the cartridge 45, in order at the same time to cause foward feed movement of the ribbon 46. The cam 84 (FIG. 2), with one of its rising cam portions, positively actuates the cam follower lever 95 which, by means of the resilient coupling means 97 and 105, causes anti-clockwise rotation of the positioning tooth 98 and the bridge member 106. At the end of the operation for pre-positioning the character 43, the tooth 98 is centered with respect to the apex of the V-shaped recess 99 in such a manner that it can reliably engage the recess associated with the selected character. The action of the tooth 98 on the recess 99 is such as to cause rotary movement of the daisy 42 by the amount required for precise centering of the blade of the selected character, in front of the hammer 49.

Continuing its rotary movement, the lever 95 subsequently causes rotary movement of the arm 107. If no tooth 109 of the element 58 is in front of the arm 107, the element 106 (see FIG. 8) is free to rotate and moves the coupling means 108 away from the path of the stop 110 of the lever 111. When the cam 83 (see FIG. 2) has a steep fall, the cam follower lever 88 rotates rapidly under the force of the spring 89, together with the lever 111, causing the hammer 49 to strike with the maximum strength which will have been manually set by means of the lever 101. If on the other hand the arm 107 meets a tooth 109 on the element 58, the bridge element 106 is stopped and stresses the resilient coupling means 105 while the coupling means 108 (see FIG. 8) remains in the path of movement of the stop 110 on the lever 111. The lever 111 can now no longer follow the cam follower lever 88 which is moved by the spring 89, and tensions the spring 112 (FIG. 2) which reduces the striking force of the hammer 49. In particular, the teeth 109 are aligned with the characters and the symbols of smaller striking area, which, by means of the above-described adjustment action, are in this way typed with a striking force which is considerably less than that in respect of characters of larger area, thus preventing cuts in the typing paper. Subsequently, the cams 83 and 84 return to the rest condition the hammer 49, the tooth 98 and the arm 107 and the cam 85 (see FIG. 7) returns to the rest condition the plate 44 and thus the ribbon 46, to permit the typed character to be visible. The armature 77 of the solenoid 79 then meets one of the actuating teeth 78 of the clutch means 77 which is thus re-opened, while in a subsequent period of time, the electronic unit 27 provides for de-energisation of the motor 75.

Figure 9:
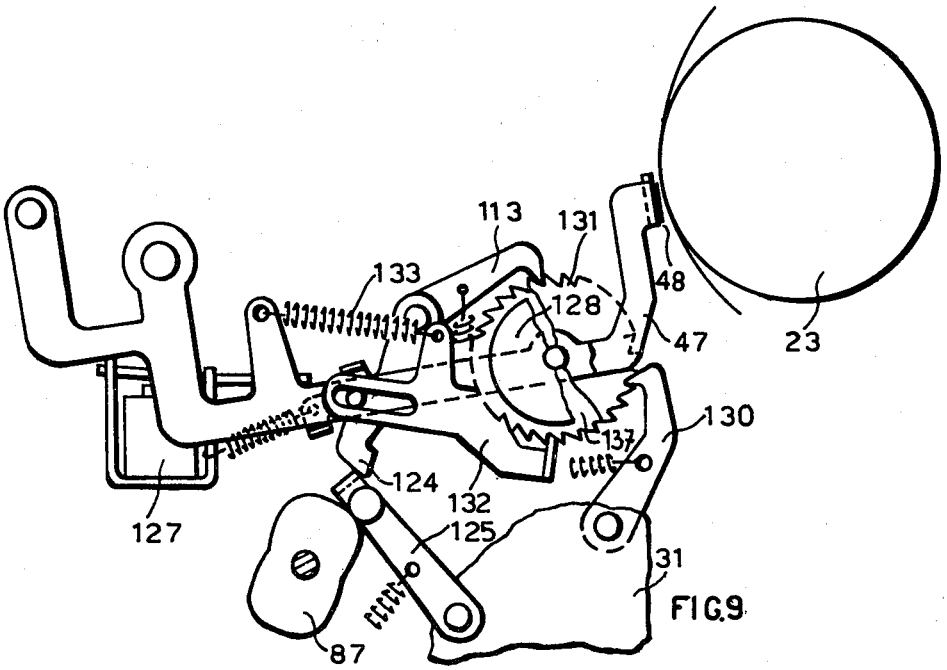
FIG. 9 is a side view of the part shown in FIG. 6, in a working position.

During the typing cycle, the rotary movement of the cam 87 (FIG. 6) and thus the oscillatory movement of the cam follower 125 have not had any effect on the frame 47 of the correction ribbon 48. If however a correction cycle is selected on the keyboard, the electronic unit 27, besides the solenoid 79, also energises the solenoid 127. The armature 126 then frees the lever 124 which, under the force of the spring 123, moves in front of the cam follower lever 125. With subsequent rotation of the cam 87, the lever 125 is rotated in the clockwise direction, meets the lever 124 and raises the frame 47 (see FIG. 9). The correction ribbon 48 is thus disposed in front of the point of typing on roller 23, for correction of the typed character. In addition, with the lifting movement of the frame 47, the toothed wheel 131 is displaced with respect to the lever 130 and causes forward feed movement of the correction ribbon 48. For replacement of the daisy 42 (see FIG. 8), the support 37 is rotated manually around the shaft 34, freeing the pin members 36 thereof from the spring positioning means 35, until the plate 38 is turned over through an angle of about 30°. This permits the boss of the daisy 42 to be easily gripped, for removal thereof from the locking element 41. During this rotary movement, the pin 90 of the intermediate lever 91 which is mounted on the support 37 slides freely in the slot 94 in the cam follower 88, freeing the hammer 49. The hair-pin spring 92 holds the hammer 49 in its rest position, with the lever 91 arrested against the pin 36 in order then to facilitate re-engagement between the pin 90 and the slot 94. By raising the lower part of the positioning element 58, with the V-shaped recesses 99 and the teeth 109, the positioning element 58 in turn does not in any way interfere with the positioning tooth 98 and the arm 107 (see FIG. 2) which remain in their respective rest positions on the carriage 31.

In addition to facilitating operations in replacing the daisy 42, this particular support structure makes it possible to provide a simple unit which can be removed from the other parts of the carriage in order readily to provide access to the mounting of the unit itself and for any repair or maintenance operations on the transducer 58 and on the components relating to selection of the daisy 42. Raising the support 37 also permits easy access to the mechanisms relating to the motor 75.

For the purposes of producing the movement of the print unit 25, the motor 28 (FIG. 1) is of the stepping type with forty eight angular positions. Fitted on the rotor thereof is a drum 154 on which is wound the wire 29 whose ends are fixed to the frame 22. For producing the movements of the carriage, in addition to being wound on the pulleys 30 which are rotatable on the frame 22, the wire 29 is also wound on two other pulleys 155 which are rotatable on the carriage 31. By means of the drum 154, the motor 28 controls forward movements of the carriage 31 at steps at spacings of 1/10", 1/12" and 1/15", which can be obtained respectively by means of rotary movements of the rotor by 6, 5 and 4 elementary steps.

Line space mechanism

Figure 10:
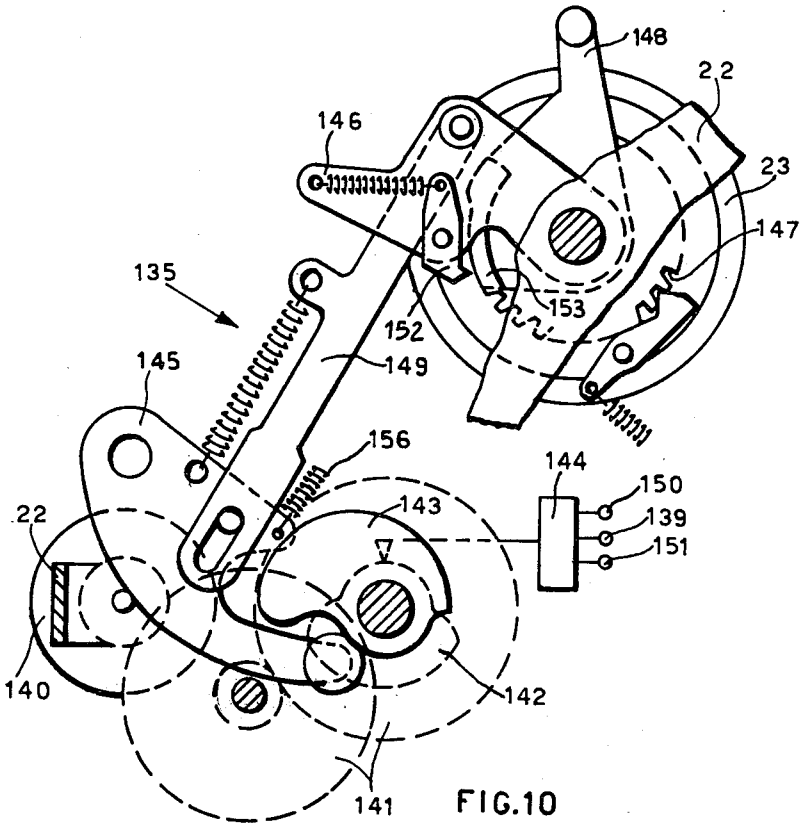
FIG. 10 is a side view of another detail of the machine of FIG. 1.

Referring now to FIG. 10, the forward feed movement of the roller 23 is produced by means of a direct current motor 140 which is fixed on the frame 22 which is connected by means of a pair of speed-reducing gears 141 to a pair of cams 142 and 143. The cam 142 comprises two cylindrical sectors with different rises, and acts on the control element of the change-over switch 144. The switch 144 has a common terminal 139 which is electrically connected to the motor 140 and two terminals 150 and 151 which are connected to the electronic unit 27 (see FIG. 12.) In particular, the unit 27 normally feeds the terminal 151 and holds the terminal 150 at zero; the cam 142 (see FIG. 10) in turn positions the control element of the switch 144 in such a way as to connect the terminals 139 and 150, thereby to hold the motor 140 in a rest condition.

By virtue of the force of a spring 156, the cam 143 is engaged by a cam follower lever 145 which, by means of a strut 149, actuates a pivotal member 146 provided with a tooth 152 which in turn is capable of engaging with a toothed wheel 147 of the roller 23. The range over which the tooth 152 is capable of engagement with the wheel 147 can be set manually by a lever 148, by means of a masking member 153, in order to adjust the line spacing of the roller 23 in per se known manner.

For the purposes of actuating the mechanism 135, the electronic unit (see FIG. 12) feeds the motor 140 by way of the terminal 150 for a period of time sufficient to cause rotary movement of the cam 142 (see FIG. 10) for switching the switch 144. The motor 140 is thus automatically supplied by the terminal 151 even in the absence of the voltage at the terminal 150. After a full revolution of the cams 142 and 143, there occurs another switching action at the switch 144 and the motor 140 stops. The rotary movement of the cam 143 causes the member 146 to carry out an operating cycle, which thus causes line spacing of the roller 23, as set by the lever 148.

Figure 12:
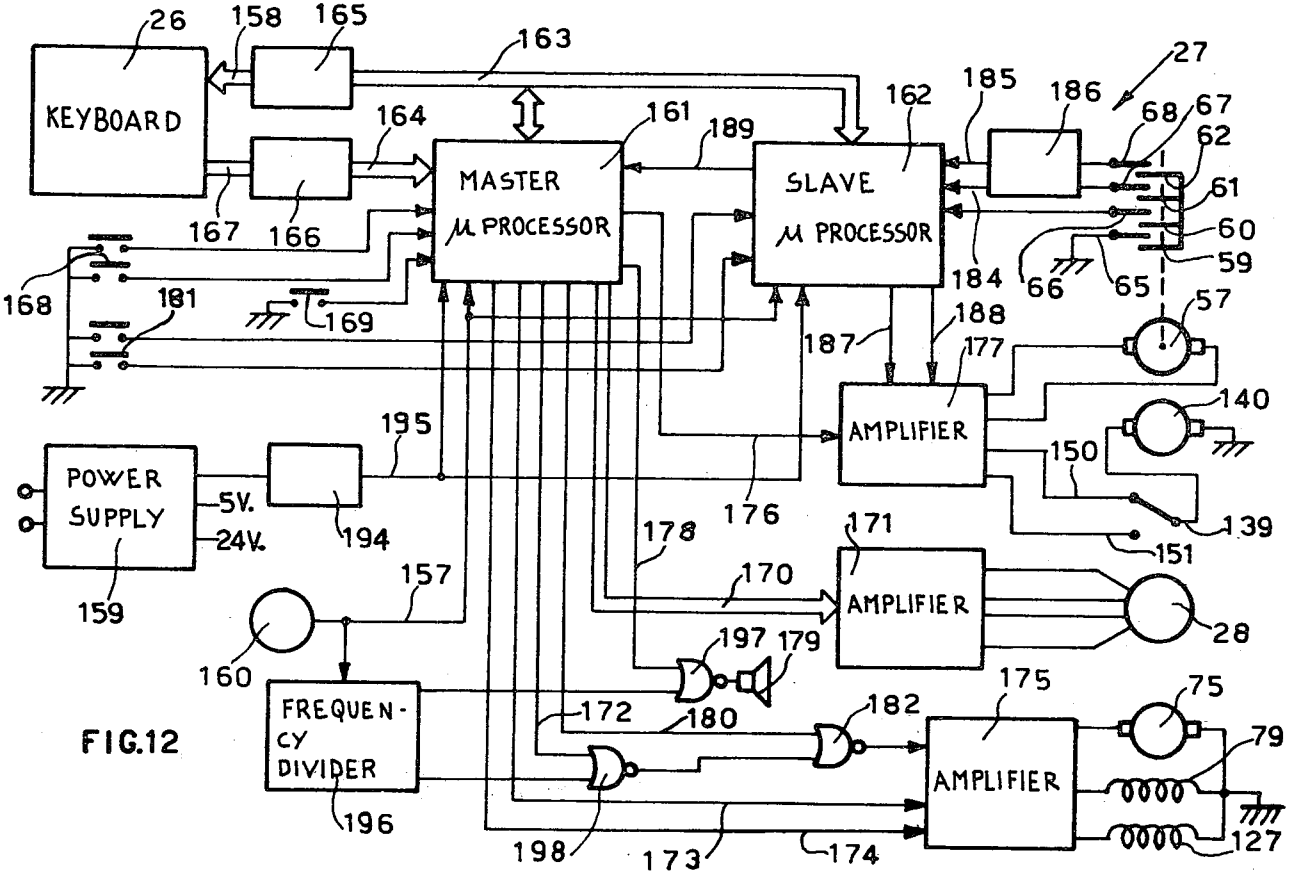
FIG. 12 is an electrical block circuit diagram of the electronic machine according to the invention.

Electronic control unit referring to FIG. 12, the electronic control unit 27 comprises a power supply means 159 with two voltages of five and twenty four volts d.c., an oscillator 160 and two microprocessors, namely, a master microprocessor 161 and a slave microprocessor 162 respectively, which interface with the keyboard 26 and are timed by 160, by way of lline 157. The microprocessor 161 codes the data from 26, by means of eight scanning lines 163 and reading lines 164.

Two circuits 165 and 166, by way of lines 158 and 167, convert the 5 V voltage levels of lines 163 and 164 into 24 V signals at the terminals of 26, which minimise uncertainties at the connections. This is obtained for example by means of 5 V amplifiers in 165, a 24 V feed in 167 and differential amplifiers between 167 and 164, with the other input polarised at 12 V.

By means of a series of operating keys of the keyboard 26, the microprocessor 161 provides for the forward movements and rearward movements of the carriage and also provides for storage, in an editing memory, of the printing format and, in a word memory, of the codes of the last ten characters whose keys in keyboard 26 were operated, for cancellation thereof from the paper. The microprocessor 161 comprises a buffer for storing the keyboard input data which has not yet been processed and performs the control actions in respect of roll-over and in respect of errors by double striking. The microprocessor 161 also processes the data from a selector 168, of two bit type, in order to pass 6, 5 or 4 pulses to the stepping motor 28, for the 1/10", 1/12" and 1/15" spacings of the carriage, and a synchronisation signal of an end-of-travel limit switch 169 which can be actuated by the carriage in its starting limit position.

By means of lines 170 and an amplifier 171, the microprocessor 161 provides for the sequential supply of the control pulses for the motor 28; in addition, by way of a pair of lines 172 and 180, the lines 173 and 174 and a three-way amplifier 175, the microprocessor actuates the motor 75 and the solenoids 79 and 127 and, by way of a line 176 and a multi-way amplifier 177, actuates the line space motor 140; finally, by way of a line 178, it provides for control of an acoustic signalling means 179.

The slave microprocessor 162 receives on its eight lines 163 the code of the key processed by the microprocessor 161. By means of four keyboard memories which can be selected by a two-bit selector 181, the above-mentioned code is suitably converted for using, with the same keyboard 26, daisies with sets of different characters, thus making it possible to type in several languages with the same typewriter. By way of two lines 184 and 185, the microprocessor 162 receives the signals from the brushes 67 and 68 which in turn are taken, by way of a filter circuit 186, from the feedback or return signals and processes those signals from the brushes to store the code in respect of the current position of the daisy. The microprocessor 162 compares that code with the desired position code which is supplied by the keyboard memory, and computes the position error to be eliminated in the direction of the shortest arcuate movement. The microprocessor 162 then provides for actuating the selection motor 57 in the most appropriate manner, by means of two lines 187 and 188 and the amplifier 177.

The two hundred switching actions per revolution, which can be produced on the lines 184 and 185, are used to determine at any moment either the speed of the daisy or the angular position thereof relative to the hammer. The slave microprocessor 162 performs a servo control action with a speed control of digital type and prmits the motor 57 to position the desired character with an error of $\pm\frac{1}{4}$ of a pitch with respect to its position of being centered with respect to the hammer. When this position has been reached, the microprocessor 162 stops the motor 57 and passes a motor stopped signal 189 to the microprocessor 161. The microprocessor 161 then provides for sequential actuation of the motor 75, the solenoid 79 and possibly the solenoid 127, and the other motors 28 and 140, in order to print the selected character and carry out the other functions in the abovedescribed manner. If however no key of the keyboard 26 (see FIG. 12) has been actuated, the microprocessor 162 causes the daisy to be positioned in the zero position of giving visibility, in the manner described in the present applicants'Italian Pat. No. 986 534. This visibility condition is recognised by the microprocessor 161 which, when it receives the motor stopped signal from line 189, will actuate neither the hammer for the print operation nor the other operating solenoids.

The unit 27 also comprises an automatic reset circuit 194 which actuates a cycle of initialization of the microprocessors 161 and 162. This causes slow rotary movement in the clockwise direction of the motors 57 and 28, and such motion terminates in the zero position of the daisy and in the end position of the carriage travel. This is detected by the brush 66 and the switch 169 which set to zero respectively the registers for storing the current positions of the daisy and the carriage. A frequency divider 196 supplies series of pulses of various frequencies, which are applied to two NOR-gates 197 and 198 of the signalling means 179 and the amplifier 175, together with the signals of lines 178 and 172. In particular, the motor 75 whose normal operating voltage is 12 volts, is actuated for operation at a continuous voltage of 24 volts during the reset cycle. This makes it possible to produce a high initial couple such as to initiate rotary movement of the shaft of the cams 82 (FIG. 1) and to perform a complete typing cycle even in the hypothetical situation that the clutch means 77 has remained open and the various cams are in the maximum load position. With the machine started, the feed to the motor 75 however is adjusted to its nominal actuating value, in a pulse mode, the amplifier 175 being 50% biased by way of the line 180 and a NAND-gate 182 (see FIG. 12). In the mode of operation thereof, actuation of a typing key, which is detected by the microprocessor 161, suddenly causes actvation of the line 180 and thus starts the rotor of the motor 75 rotating. The microprocessor 162 in turn causes the blade of the desired character to be positioned in front of the point of typing, then transmitting the motor stopped signal 189. After a delay time of about 60 msec. from the end of the selection action, the master microprocessor 161 causes energization of the solenoid 79 for a predetermined period of time. If however a correction key 199 (see FIG. 1) has been previously actuated, the microprocessor also causes energization of the solenoid 127. This causes closure of the clutch means 77 (see FIG. 2) and possibly pre-disposition for use of the correction ribbon 48. After a further time delay, the microprocessor 161 (FIG. 12) then actuates the motor 28 for forward movement of the carriage by the space selected by the selector 181.

If no other character has been selected, the master microprocessor 161 deactivates the line 180, stopping the motor 75. However, in the event of several characters to by typed in sucession, the master microprocessor 161 keeps the motor 75 in an energized condition and transmits the command for the solenoid 79 which has no sooner received the signal 189, thus saving on the time for starting the motor 75 for each character following the first.

In accordance with a further feature, by means of keys 209 (FIG. 1) and 210, a series of tabulation positions and margin positions in respect of the carriage 25, along the line of typing, can be stored in the editing memory of the microprocessor 161. These positions are attained by movements of the carriage either forwardly or rearwardly. The program of the master microprocessor is also such as to cause the carriage always to arrive at the desired position at the same speed and in the same direction of movement, for example from left to right. For this purpose, the speeds imparted to the carriage are tabulated in dependence on the number of movement steps or pitches. In addition, if the direction of movement of the carriage is opposite to that of the program, the master microprocessor 161 causes the carriage firstly to be positioned by one pitch or step to the left of the desired point and then moves it by a pitch or step to the right, into the selected position. This makes it possible to use wires 29 for transmission of the motion, which are sufficiently flexible, being for example of plastics material fibres, drums 154 and possibly speed reducing gears which are not corrected, without detrimentally affecting alignment of the points of typing. For this purpose, the microprocessor 161 comprises a register for storing a bit relative to the direction of movement of the carriage in the tabulation mode or in the return to the desired starting point by a key 216 or a key 217. If the bit is that of the predetermined direction of movement, the code representing the desired position is directly transferred into a working register. If however the bit is different, it is transferred in a condition of being decremented by one pitch or step. The microprocessor then causes the carriage to move forward, and it resets the memory register. The microprocessor 161 controls the motor 28, for example as described in Italian patent No 1 009 488. In dependence on the position of 168, a key 230 or 231 moves the carriage 28 rearwardly by a pitch or half a pitch. The microprocessor 161 transmits to 28, 6, 5 or 4 pulses for 230 and 3 or 2 pulses for 231. If 168 is in the 1/12" position, with the second actuation of 231, the key 231 however transmits three pulses, rephasing the stepping movement of the carriage 28 which was dephased with 2 pulses transmitted with the first actuation of 231.

Figure 13:
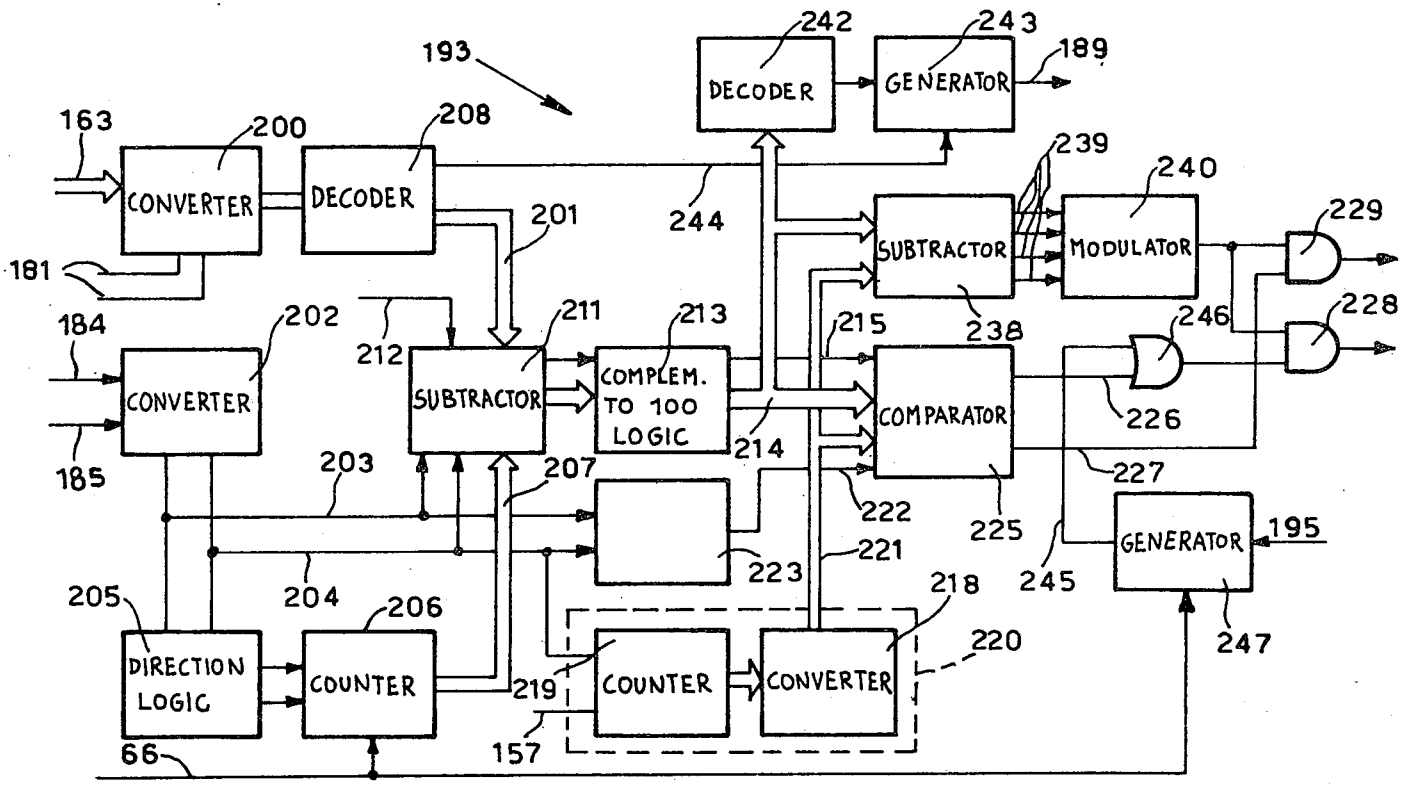
FIG. 13 is an elevational block circuit diagram of an alternative form of a detail of the diagram of FIG. 12.

The functions of 162 are also performed by the control unit 193 in FIG. 13, comprising a conversion circuit 200 for the eight bits of lines 163. One the basis of the condition of the lines 181, a recognition circuit 208 activates a seven-bit line, with a code associated with the 100 possible angular positions of the daisy 42, and which represents the desired angular position of the daisy.

Figure 15:
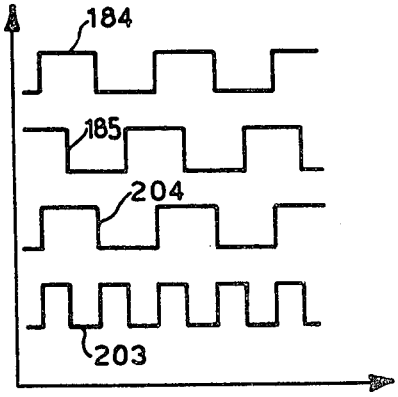
FIG. 15 shows some signals of the circuit diagram of FIG. 13.

The signals on lines 184 and 185 which are derived from the brushes 67 and 68 after filtering, are considered as bits of a GRAY code 10; 11; 01 and 00 which define in absolute terms the four possible positions which can be obtained within the limit of one of the fifty angular steps of the tracks 61 and 62 (FIG. 14) of the printed circuit 64. The signals on 184, 185 are passed to a circuit 202 (FIG. 13) which converts the received code into a binary code for actuation of the outputs 203 and 204 (see also FIG. 15), and which represents the two least significant figures of the daisy 42 position code.

The switching actions from 11 to 00 or from 00 to 11 of the outputs of 203 and 204 are verified alternatively in the event of rotation in a clockwise direction or in an anti-clockwise direction of the circuit 64. They are detected in a logic circuit 205 (see FIG. 13) which recognises that direction of rotation, clockwise or anti-clockwise, of the daisy, and respectively actuates the increment or decrement inputs of a bi-directional counter 206. The counter 206 has a capacity of six bits and its output 207 represents, in incremental manner, the angular movements of the daisy in 1/50 of a revolution. In the initialization phase, the counter 206 is set to zero and is thus synchronized with the zero plosition of the daisy 42, when the brush 66 detects the single tooth 60 (FIG. 14) of the associated synchronization track. After initialization, the six bits of the lines 207 (FIG. 13) of the counter 206 and the two bits of the lines 203 and 204 consequently represent at any moment the code of each of the two hundred different positions of the daisy 42, which can be detected by the brushes 67 and 68.

The value and sign in respect of the angular distance between the actual position and the desired position of the daisy 42 are produced in a subtracting circuit 211 which algebraically subtracts the code of the lines 203, 204 and 207 from the code of the output lines 201 of the converter 200. In addition, an eighth bit constantly at 1 is added to the seven bits of the line 201, on a line 212, thereby to cause the difference between the two codes to be zero only when the daisy 42 is positioned with respect to the hammer with one of the characters and not with the space between two adjacent characters. A circuit 213 produces the complement to 100 of the angular distance and changes the sign thereof in the event that the distance calculated is greater than one hundred, which would imply rotary movement of the daisy of more than 180°. The circuit 213 has an eight bit output 214 and a one bit line 215 which consequently represent respectively in value and sign, the position error or indeed the code of the minimum number of angular steps still required for selecting the desired character.

In accordance with one of its features, the typewriter according to the invention comprises a tachometric circuit 220 which digitally detects the speed of the selection motor 57 and a control circuit which causes the motor to rotate at a speed proportional to the angular position error of the daisy. The control circuit supplies the motor with power in a digital manner, by means of constant voltage pulses, whose length varies incrementally in order progressively to bias the power of the motor in dependence on the error between the detected speed and the imposed speed. This makes it possible to have a servo control with a high degree of reliability and at a very low cost relative to the mixed control systems of analog-digitaltype.

The tachometric circuit 200 (FIG. 13) receives the lower-importance code 204 of the converter 22, which is formed by one of the two hundred switching actions for each revolution of the daisy 42. The circuit 220 is timed by the clock signals of the line 157 and an internal counter 219 thereof counts the number of clock signals between the last code received and that immediately preceding. This number which is inversely proportional to the speed of the daisy is converted by means of a table-type conversion circuit 218 and, on its lines 221, provides the measurement in respect of the speed of the motor 57. The circuit 218 is also provided with an internal threshold such as to cause the speed corresponding to a switching time of around 6 msec. to be considered as zero speed.

A circuit 223 which is supplied by the lines 203 and 204 actiavates a line 222 for indicating the direction of angular movement of the daisy. The code with the seven bits of the lines 221 plus the it of the line 222 is passed to a comparator 225 which compares it to the code in respect of the position error detected on lines 214 and 215. The comparator 225 is of the type comprising four quadrants and, according to which of the two codes is the greater, by means of lines 226 and 227 it respectively actuates an AND-gate 228 or an AND-gate 229 which in turn cause the motor 57 to rotate in the clockwise or anticlockwise direction. In addition, when the two codes are equal, the two gates are blockes and interrupt the supply of power to the motor 57.

Figure 16:
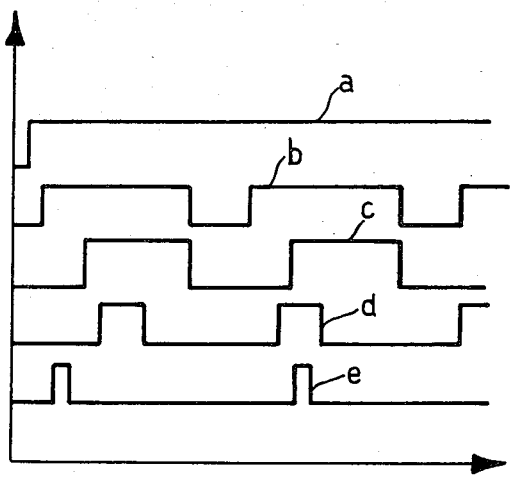
FIG. 16 shows other signals of the circuit diagram of FIG. 13.

The absolute values of the six bit speed code 221 and the eight bit position code 214 are passed to a subtracting circuit 238 which is provided with four output lines 239 for indicating the difference between the two codes. The substracting circuit 238, with its lines 239, controls a modulating circuit 240 which in turn supplies the AND-gates 228 and 229. According to which one of the lines 239 is energized, the modulating circuit 240 supplies a continuous signal (FIG. 16) as at a, or progressively biased signals b-e, in dependence on decreasing values in respect of the calculated difference between the speed code and the position code. In particular, when the difference between the codes is greater than four bits, the four lines 239 are at one with each other and the motor 57 is piloted with a maximum current for maximum current for maximum acceleration, while the motor is supplied with a medium-value current which gradually reduces when the difference between the codes is progressively decreased. The current of the motor 57 is in phase with its e.m.f. during acceleration, while it is in phase opposition during the braking mode.

Figure 17:
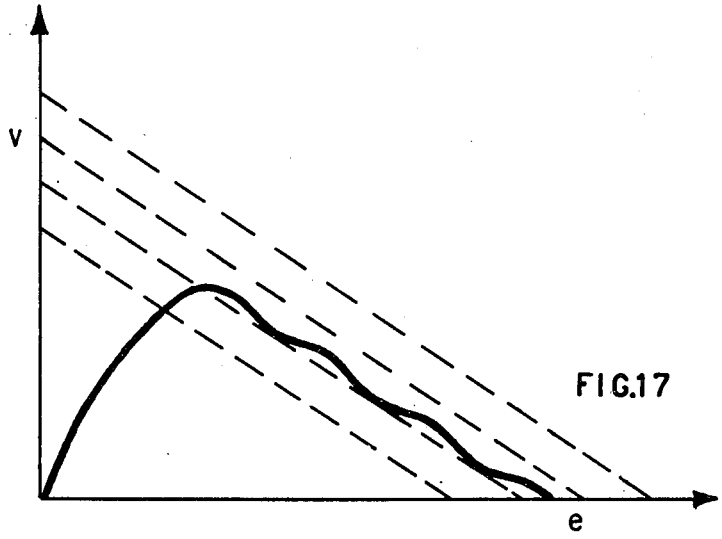
FIG. 17 is a working graph of a part of FIG. 12.

By means of the comparison between the position code and the speed code and the piloting of the motor in dependence on the difference between the codes, the law of motion imposed on the motor is that in which the speeds are proportional to the position errors (outlined in FIG. 17). The biasing action in respect of the motor current, which is produced with the modulating circuit 240, makes it possible to minimise the oscillations in the speed of the motor (in solid line in FIG. 17) with respect to the above-mentionel law. When the character to be typed is in the vicinity of the hammer, the speed corresponding to the last switching action is considered zero by the circuit 220, the position error is already zero and the subtracting circuti 238 permanently detects a zero difference. The modulating circuit 240 then de-energizes the motor 57 which tends by inertia also to produce a residual rotary movement of the daisy 42 (FIG. 2), this being prevented by the braking action of the scissor-like arms 53 on the element 58. This ensures that inertia rotary movements of more than $\frac{1}{4}$ of angular pitch cannnot initiate oscillations, which are more or less permanent, about the rest positions, while ensuring that the final positioning of the character is effected with the requilred degree of accuracy of $\pm\frac{1}{4}$ of a pitch with respect to the reference position.

In the normal print cycles, a decoding circuit 242 detects the zero value in respect of the position error on the lines 214 and actuates a delayed pulse generator 243 which supplies the signal 189 required for actuation of the clutch means 78 (see FIG. 2).

In the event that no key of the keyboard has been operated, the recognition circuit 208 recognises the absence of input data and, after a predetermined delay, supplies the lines 201 with the code of the underlining blade which enhances visibility of the last character typed and also passes to the pulse generator 243 a signal 244 which prevents operation thereof, on arrival of the control signal from the circuit 242.

During the initialization phase, a circuit 247 which is activated by the reset signal on the line 195 supplies power to the motor for rotation at low speed and in an anticlockwise direction, by means of pulses which are applied to the gate 228, by means of a line 245, and an OR-gate 246. This continues until a time when the brush 66 does not detect the movement of the daisy therepast for the zero position. The signal of the brush 66 then sets to zero the position counter 206 and disables the circit 247, stopping the daisy in the zero position.

Figure 18:
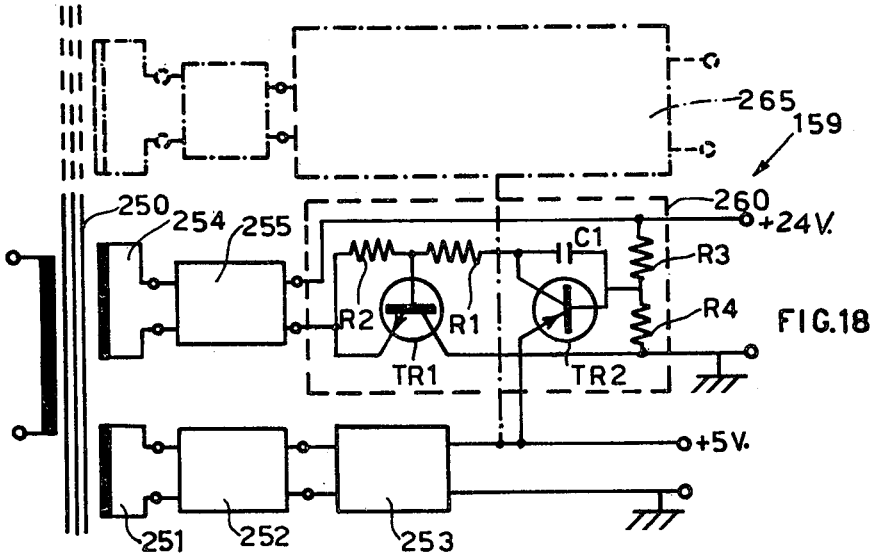
FIG. 18 is an electrical circuit diagram of a block in FIG. 12.

The supply means 159 (FIG. 12) comprises a transformer 250 (FIG. 18) whose secondary winding 251 provides a stabilized voltage of +5 V, with reslpect to earth, for the logic circuits, by way of a rectifier means 252 and an integrated regulating circuit 253, in per se known manner. The transformer 250 is provided with a secondary circuit 254 to which there are connected a rectifier means 255 and a voltage stabilizing means 260 for a stabilized power supply at a voltage of 24 V, which is required for the power circuits of the machine.

In accordane with a further feature of the invention, the stabilizing means 260 comprises a power transistor TR1, which is used as a sereis regulator and whose collector is connected to earth. The control current of TR1 is supplied by a piloting transistor TR2 which compares a part of the output voltage which is derived with a divider comprising resistors R3 and R4, with a fixed reference voltage which is formed by the stabilized 5V voltage from the circuit 253. A capacitor C1 between the collector and the base of the transistor TR2 prevents the input of parasitic oscillations and resistors R1 and R2 provide respectively for the connection between the two transistors and the polarization thereof.

The above-described circuit which regulates the output voltage on the side referred to earth makes it possible to fix the collector of the power transistor TR1 which is formed by the metal casing of the transistor, in direct contact with the associated heat sink. The latter which is generally connected to earth promotes maximum dissipation of the heat of the transistor, without the heat barrier represented by the insulating means which are absolutely required in the case of known stabilizing means where regulation is effected on the high-voltage side.

The reference to earth of TR1 and the use of the 5 V stabilized voltage which is used for the logic parts of the machine make it possible to eliminate the specific circuit for forming the fixed reference voltage and to reduce the saturation voltage of the transistor TR1. This circuit arrangement is found to be particularly advantageous when a second stabilized voltage is required. In the latter case in fact, the 5 V voltage of the logic circuit also represents the reference voltage for another stabilizing means which is indicated by a dash-dotted line at reference 265 in FIG. 18. The collector of the power transistor of the second stabilizing means will also be directly connected to its heat sink which may be the same as that of the transistor TR1 of 260.

It will be apparent that various modifications may be made in the above-described description without thereby departing from the scope of the invention.

What we claim is:

1. An electronic typewriter comprising a character-carrier disc having flexible fingers, each one carrying a character, a selection motor having the rotor connectable with the disc for the rotation thereof, a digital transducer for revealing incremental rotations of said character-carrier disc and having a plurality of switching area associated with said fingers, and sensing means revealing the presence of said switching areas on a predetermined position for generating a transducer position signal, wherein said transducer position signal is representative of a coarse location of each of said fingers in front of the point of typing, a velocity servo-control circuit for the selection motor including a first means responsive to angular distances of the desired character from the coarse location for generating a corresponding desired velocity signal, second means responsive to each transducer position signal and to a preceding transducer position signal for generating an actual velocity signal, and motor actuating means responsive to said actual velocity signal and to said desired velocity signal for causing the rotor of said selecting motor to be rotated in accordance with a predetermined law of motion, wherein said velocity servo-control means arrests the rotor when the desired character reaches said coarse location in front of the point of typing, and means for fine positioning said desired character in front of the point of typing comprising a correction wheel mounted synchronously with said character-carrier disc and provided with a series of peripheral recess means associated with said fingers, tooth means actuatable for engaging with each of said series of recess means, and correction actuating means responsive to reached coarse location of said desired character for actuating said tooth means, and wherein the engagement of said tooth means with said recess means causes fine positioning of the desired character in front of the point of typing.

2. A typewriter according to claim 1 wherein said switching areas are distributed along two peripheral tracks and are respectively out-of-phase by half a step, wherein said sensing means comprise a couple of sensors for revealing the presence of each of said switching areas of said tracks with respect to said sensors, and wherein the coarse location of each character is defined by a predetermined code combination of said switching areas revealed by said couple of sensors.

3. A typewriter according to claim 1 wherein the rotating support of said transducer comprises an insulating plate and carries a conducting track and a conducting layer, wherein said switching areas are defined by discontinuities in said track, wherein said sensing means comprise at least a brush sliding on said conducting track for revealing said discontinuities, and wherein said conducting layer is insulated from said track and is carried a small distance from said track for reducing the sliding movement of said brush on the insulating plate.

4. A typewriter according to claim 1 further comprising an operating motor and a hammer actuatable for the typing of the desired character, and wherein said tooth means and said hammer are actuated by cam means which are rotated by said operating motor under the control of said correction actuating means.

5. A typewriter according to claim 4 wherein said operating motor has a rotor rotatable at each printing cycle, wherein said cam means are connected with the rotor of said operating motor through a clutch and wherein said correction actuating means comprises electromagnetic means which actuates said clutch for a cyclic rotation of said cam means.

6. A typewriter according to claim 1 further comprising a shaft on which said character-carrier disc is mounted and a pair of gears between said selection motor and said shaft for reducing the angular speed of the disc with respect to the speed of the motor and wherein said correction wheel is fixed on said shaft.

7. A typewriter according to claim 1 further comprising a subtracting circuit controlled by said transducer for computing the position error of the character-carrier disc between the angular position required for selection of the desired character and the instantaneous position, wherein said control circuit imparts to the motor a speed proportional to said position error.

8. A typewriter according to claim 7 characterised in that the subtracting circuit is provided with a series of outputs which represent the digital code of said position error and that said control circuit comprises a tachometric circuit whose outputs represent the digital code of the speed of the disc, and a comparison circuit for producing an actuation command for said motor in response to a digital code in respect of the difference between the digital speed code and the digital code in respect of the position error.

9. A typewriter according to claim 1 further comprising a drive shaft on which said character-carrier disc is fixed and a positioning disc which is fitted on the drive shaft wherein said correction elements comprise a series of V-shaped recesses provided on a peripheral edge of said positioning disc and associated with said fingers.

10. A typewriter according to claim 9 characterised in that the transducer is carried by said positioning disc.

11. A typewriter according to claim 1 further comprising braking means which retard a drive shaft on which said disc is mounted in order to damp any oscillations which may occur during the approximately positioning thereof in front of the point of typing.

12. An electronic typewriter comprising a character-carrier disc having flexible fingers, each carrying a character, a shaft member for removably mounting said disc for serially positioning said characters in front of the point of typing, wherein said shaft member comprises a gear, a selection motor having a rotor fixing a pinion which engages with said gear for rotating said disc and reducing the speed of said disc with respect to the speed of the rotor, a position transducer including a rotational part fixed with said shaft member and having a plurality of switching areas associated with said fingers and sensing means revealing the presence of said switching areas on a predetermined position for generating a transducer position signal representative of a coarse location of each of said fingers in front of the point of typing, servo-control means for the selection motor responsive to the angular distance of the desired character from its coarse location for causing the rotor of said selecting motor to rotate said character-carrier disc and arrest it when the desired character reaches said coarse location in front of the point of typing, a correcting position wheel fixed on said shaft member having recess means on the periphery thereof associated with said fingers, tooth means actuatable for engaging with said recess means to fine position the desired character in front of the point of typing, and correction actuating means responsive to reached coarse location of the desired character for actuating said tooth means.

13. A typewriter comprising a character-carrier disc having flexible fingers, each one carrying a character, a selection motor having the rotor operatively connected with the disc for intermittently rotating the disc until a desired character is coarsely located in front of the point of typing, means for fine positioning said desired character in front of said point of typing comprising a correction wheel mounted synchronously with said character-carrier disc and provided with a series of peripheral positioning surfaces associated with said fingers, tooth means actuatable for engaging said positioning surfaces for fine positioning the character from said coarse position to said fine position in front of the point of typing, a hammer actuatable for the typing of the desired character, cam means for actuating said tooth means and said hammer, an operating motor having a rotatable rotor, and control means responsive to the coarse positioning of said desired character for causing the rotor of said operating motor to actuate said cam means.

14. A typewriter according to claim 13 characterised by clutch means interposed between the rotor of the operating motor and said cam means and a solenoid controlled by the control means for cyclically actuating said clutch means.

15. A typewriter according to claim 13 characterised by further connecting elements between said operating motor and a means for forward feed movement and raising movement of a typing ribbon with respect to the point of typing.

16. A typewriter according to claim 13 characterised by an element capable of connecting the operating motor to a means for the forward feed movement and the raising movement of a correction ribbon with respect to the point of typing, and an electromechanical means selectable by said control means for actuating said connecting element.

17. An electronic typewriter comprising a print unit including: a character-carrier disc having flexible fingers, each carrying a character, a rotatable shaft member removably mounting said disc for serially positioning said characters in front of the point of typing, a selection motor having a rotor operative on said shaft member to intermittently rotate the disc until a desired character is located in front of the point of typing, a correcting wheel fixed on said shaft member and having on its periphery a plurality of recesses associated with said fingers, a tooth lever for cooperating with each of said recesses to exactly position the desired character in front of the point of typing, a hammer actuatable for the print of the desired character, and actuating means for said tooth lever and said hammer, a paper supporting platen and a carriage for transporting said print unit transversely with respect to said platen, wherein said carriage comprises a first section adapted to be mounted adjacent to said platen for movement parallel to said platen and a support member pivotable on said first section for movement between first and second positions relative to said platen, wherein said support member comprises means for supporting said motor and said shaft member and means for guiding said hammer and wherein said first section comprises means for guiding said tooth lever, wherein said tooth lever is located adjacent to the periphery of said correcting wheel and said actuating means are connected with said hammer in the first position of said support and wherein said correcting wheel is away from said tooth lever and said hammer is released from said actuating means in the second position of said support.

18. A typewriter according to claim 17 wherein said actuating means comprise a pair of members of said actuating means and of said hammer including a slotted element and a pin element, wherein said pin is engaged in said slotted element for the actuation of said hammer in the first position of said support and wherein said pin element releases said slotted element in the second position of said support.

19. A typewriter according to claim 1 further comprising a shaft on which said disc is mounted, and a pair of gears between said motor and said shaft for reducing the speed of the disc with respect to the speed of the motor, and means fixing said transducer on said shaft.

20. A typewriter according to claim 1 further comprising an operating motor, connecting elements between the rotor of said operating motor and said correction wheel and a circuit for controlling the operating motor, which actuates said correction member after positioning of the positioned character.

* * * * *